US006261115B1

(12) United States Patent
Pederson et al.

(10) Patent No.: US 6,261,115 B1
(45) Date of Patent: Jul. 17, 2001

(54) CONNECTOR MODULE

(75) Inventors: Steven Pederson, Peachtree City, GA (US); Timothy J. Miller, Warren, PA (US)

(73) Assignee: Tyco Electronics Logistics Ag, Steinach SG (CH)

( * ) Notice: Subject to any disclaimer, the term of this patent is extended or adjusted under 35 U.S.C. 154(b) by 0 days.

(21) Appl. No.: 09/330,748

(22) Filed: Jun. 11, 1999

(51) Int. Cl.[7] ..... H01R 13/627
(52) U.S. Cl. ..... 439/352; 439/489
(58) Field of Search ..... 439/350–358, 439/488–489

(56) References Cited

U.S. PATENT DOCUMENTS 5,879,180 * 3/1999 Iwahori et al. ..... 439/352
5,910,027 * 6/1999 Wayt et al. ..... 439/489
6,068,507 * 5/2000 Popa ..... 439/489

* cited by examiner

*Primary Examiner*—Khiem Nguyen
(74) *Attorney, Agent, or Firm*—Brinks Hofer Gilson & Lione

(57) ABSTRACT

A connector module is provided that includes a first connector housing, a second connector housing and a connector positive assurance member. Insertion of the first housing into the second housing will cause a latching mechanism located within the assembled first and second housings to latch the housings together so that they can not be readily disengaged. When the first and second housings are fully engaged in this manner, the connector positive assurance member may be moved from a first position to a second position to assure complete engagement has been effected and to lock the housings together. If the first and second housings are not filly engaged, the connector positive assurance member can not be moved from such first position to such second position.

21 Claims, 6 Drawing Sheets

CONNECTOR MODULE

CROSS-REFERENCE TO RELATED APPLICATION

This application claims the benefit under 35 U.S.C. § 119(e) of the U.S. provisional application Ser. No. 60/094,616, filed on Jul. 30, 1998.

TECHNICAL FIELD

The present invention relates to a connector module, that includes internal latch engagement members and comprises a first connector housing that mates with a second connector housing. A positive assurance member is attached to one of the connector housings in a pre-locked mode. The positive assurance member assures that the housings are fully mated, and contacts therein are filly engaged, in an engaged mode, and that the housings are locked together, in a locked mode.

BACKGROUND ART

It is occasionally desirable to provide electrical connectors that may be mechanically and electrically connected together but not readily disconnected. For example, the ability to easily disconnect an electrical connector module creates a potential safety hazard in high voltage applications. Such a concern exists in some electrical connections located under the hood of a motor vehicle. One known device to deter separation of electrical connectors involves the use of mating connector housings that are snap fit together, a lock disabler being provided to prevent unsnapping thereof U.S. Pat. No. 5,370,550 is an example of such a device. However, a device of this type may be disconnected, if desired. Other known devices rely upon the use of connector position assurance (CPA) members such as described in U.S. Pat. No. 5,236,373. In structures of this type the CPA engages mating connector housings exterior thereof to lock such housings together. Such a CPA is not designed for use with connectors having internal latches that are not exposed to the outside of the connector. However, when internal latches are provided, use of a CPA is desirable to assure that the connector housings and contacts therein are mated, since there typically is no visual indication of such mating. This may be a particular concern in view of the tendency towards smaller connector bodies that house smaller connector contacts that make visual indication less likely. Another concern in view of this tendency is the requirement that such smaller connector bodies meet the same performance requirements as larger conventional embodiments. In order to enhance the performance of such smaller connector bodies, it has been determined that a preferred material is LCP (liquid crystal polymer) or a material having the same characteristics. Hereinafter, the material will be referred to as LCP.

Connector bodies fabricated from this material must satisfy performance requirements of the finished product. The performance characteristics of LCP material must also be taken into consideration. Another concern is that during fabrication of LCP connector housings by, for example, a conventional molding operation, the LCP material presents problems regarding weld line strength and filling characteristics of the material. Further, the flexible yet stiff nature of the LCP material presents concerns regarding the ability to fabricate a practical smaller connector module having a CPA and an internal latch.

DISCLOSURE OF THE INVENTION

It is an object of the present invention to provide a connector module that obviates the disadvantages of the prior art.

It is yet another object of the present invention to provide a connector module having a connector positive assurance member that can only be actuated when the connector module is fully engaged in an engaged mode.

It is another object of the present invention to provide a connector module having a connector positive assurance member that is preinstalled in a pre-locked mode to one of the connector housings of the connector module.

A further object of the present invention is to provide a connector module having a connector positive assurance member and including a latch engagement member that is hidden from view when fully engaged in an engaged mode.

Yet a further object of the present invention is to provide a connector module fabricated from LCP that meets all of the foregoing objectives.

Another object of the present invention is to provide a connector module that may be fabricated from LCP having the required weld line strength.

A further object of the present invention is to provide a relatively small connector module fabricated from LCP and having a CPA that has satisfactory rigidity and resistance characteristics.

This invention achieves these and other objects by providing a connector module comprising a first and second connector housing and a positive assurance member. The first connector housing extends from a first end portion to an opposite second end portion and comprises a lug extending from a first connector housing surface. The second connector housing extends from one end portion to an opposite end portion and comprises a resilient locking tongue. The locking tongues comprises a first tongue portion extending from a fixed end, attached to a second connector housing wall, to a first free end, and a second tongue portion extending from the first free end to an opposite second free end. The second free end comprises an engagement member. The second connector housing is slidably engagable with the first connector housing in the direction of a longitudinal axis to fully engage and disengage the lug and the engagement member in an engaged and disengaged mode, respectively. The resilient locking tongue is structured and arranged such that movement of the first tongue portion towards the longitudinal axis causes movement of the engagement member away from the longitudinal axis, in a disengaged mode, and release of the first tongue portion permits the engagement member to resile towards the longitudinal axis, in an engaged mode. The positive assurance member is movably attached to the second connector housing and is structured and arranged such that in the engaged mode, movement of the positive assurance member in a locking direction positions the positive assurance member in relation to the locking tongue to sufficiently resist the movement of the first tongue portion towards, and the engagement member away from, the longitudinal axis to lock engagement of the lug and the engagement member in a locked mode.

BRIEF DESCRIPTION OF THE DRAWINGS

This invention may be clearly understood by reference to the attached drawings in that like reference numerals designate like parts and in that.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
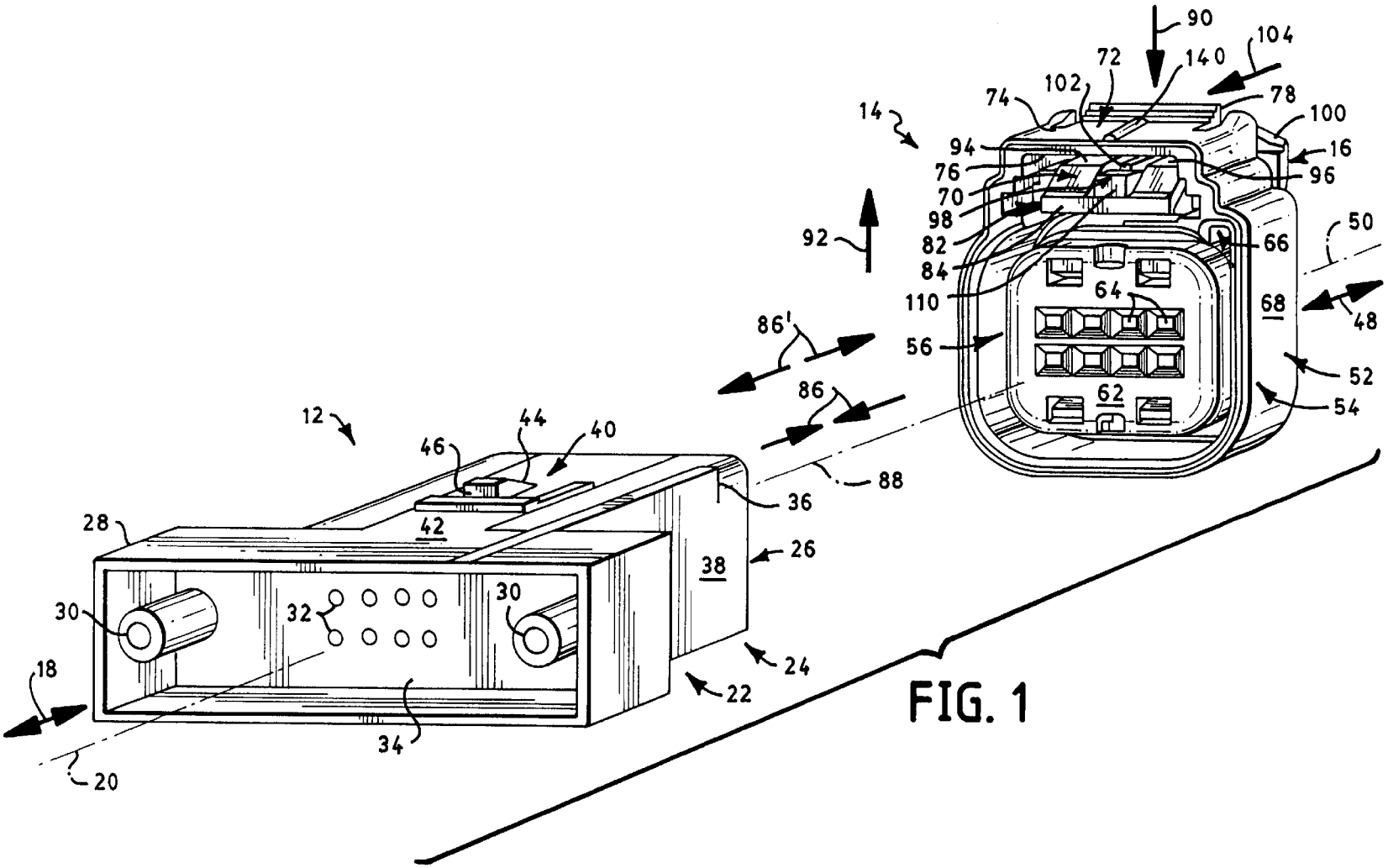
FIG. 1 is an exploded perspective view of one embodiment of the connector module of the present invention.
Figure 2:
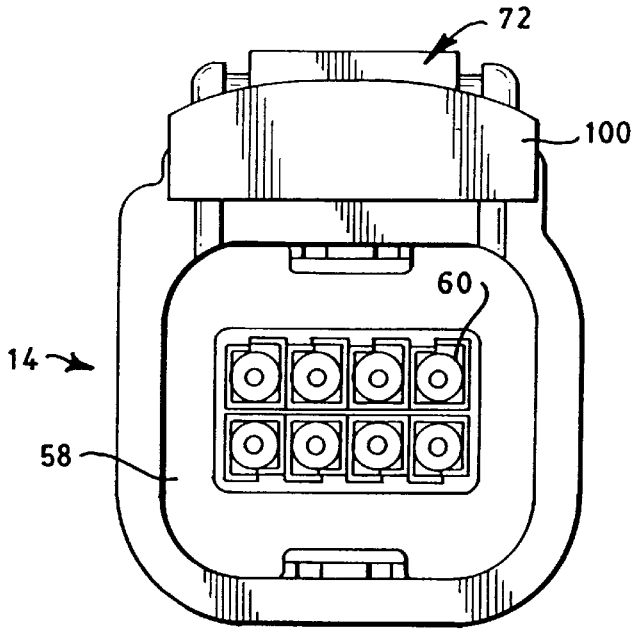
FIG. 2 is an end view of the connector housing 14 of FIG. 1.
Figure 3:
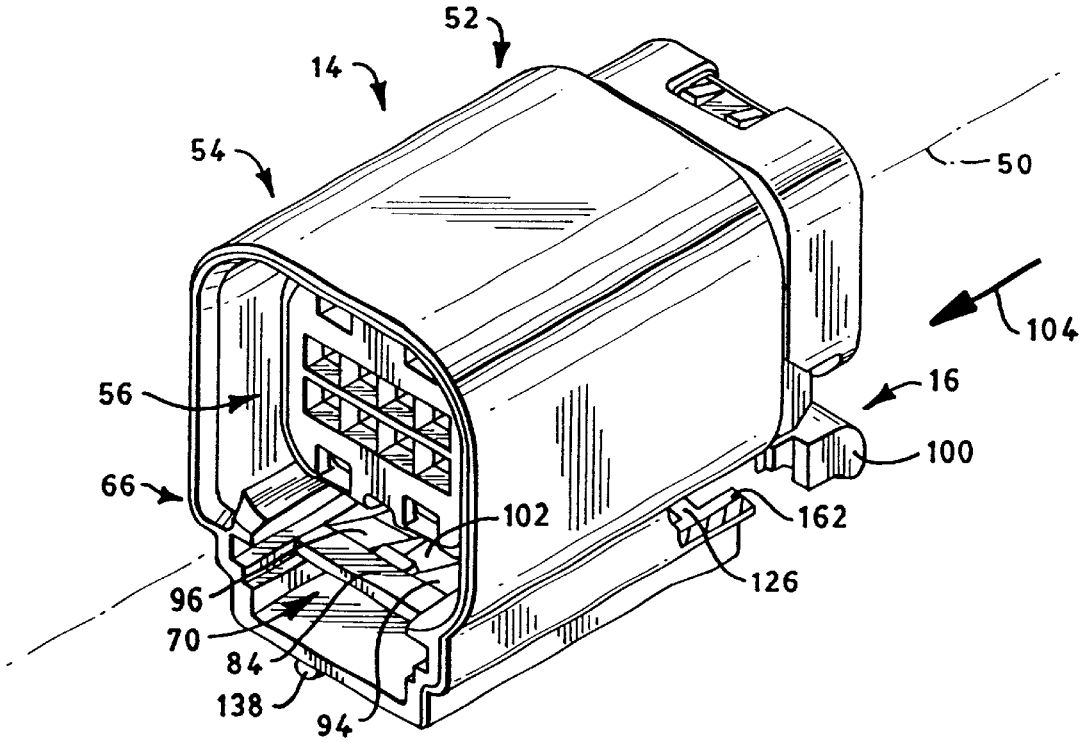
FIG. 3 is a perspective view of the connector housing 14 of FIG. 1 viewed from the bottom.

The embodiment of this invention that is illustrated in the drawings is particularly suited for achieving the objects of this invention. FIGS. 1 to 3 illustrate a connector module comprising a first connector housing 12 and a second connector housing 14. Housings 12 and 14 are slidably engagable with each other as explained herein. The connector module illustrated in FIGS. 1 to 3 also comprises a connector positive assurance member 16.

The connector housing 12 extends in direction 18 of an axis 20 from an end portion 22 to an opposite end portion 24. Housing 12 comprises a cavity 26 therein and a housing base 28 having holes 30 through that mounting members such as screws (not shown) may be inserted for mounting the housing 12 to a support surface such as an automobile panel. Housing 12 comprises a plurality of contacts therein(not shown) each of that extends through a respective bore 32 in the base 28 and into cavity 26. The end of each contact extending out of cavity 26 from the surface 34 of the base 28 may be connected to a suitable conductor in a conventional manner. The contacts within housing 12 may be conventional male or female contacts. In the embodiment illustrated in FIGS. 1 to 3, the contacts within cavity 26 are male contacts. End portion 24 is structured and arranged to mate with the housing 14. To facilitate such mating, the housing 12 comprises a key member. In particular, housing 12 comprises an elongated key 36 that extends from surface 38. Key 36 is directed in the direction 18 of axis 20. The housing 12 comprises a lug 40 extending from a surface 42. Lug 40 comprises an angular lug camming surface 44 and a lug abutment surface 46.

The connector housing 14 extends in the direction 48 of an axis 50 from an end portion 52 to an opposite end portion 54. Housing 14 comprises a cavity 56 therein and a cover 58 that encloses the end portion 52. Housing 14 comprises a plurality of contacts therein (not shown). A plurality of conductors extend into housing 14, each conductor being connected to a respective contact In particular, each conductor (not shown) extends through a respective bore 60 in cover 58 for conventional electrical and mechanical attachment to a respective contact. For example, each conductor may be soldered to a respective contact in the usual manner. The contacts within housing 14 may be conventional male or female contacts. In the embodiment illustrated in FIG. 1, the contacts within cavity 56 are female contacts. Housing 14 comprises a cover 62 within cavity 56, such cover having a plurality of bores 64 that are in alignment with the male contacts within the housing 12. End portion 54 is structured and arranged to mate with the end portion 24 of housing 12. To facilitate such mating, housing 14 comprises a key member. In particular, housing 14 comprises an elongated keyway 66 that extends adjacent wall 68 of cavity 56. Keyway 66 is directed in the direction 48 of axis 50. The key 36 and keyway 66 are structured and arranged to mate with one another to facilitate the slidable engagement of the housings 12 and 14. The male and female contacts in respective housings 12 and 14 are structured and arranged to mate with each other in a conventional manner during such slidable engagement to provide electrical and mechanical connection between each With reference to FIGS. 1 to 5, the connector housing 14 comprises a resilient locking tongue 70 comprising a first tongue portion 72 extending from a fixed end 74 attached to a wall 76 of the housing 14 towards the first end portion to 52. The first tongue portion 72 extends to a first free end 78. The locking tongue 70 comprises a second tongue portion 80 that extends from the free end 78 towards the second end portion 54. The second tongue portion 80 extends to a second free end 82. The free end 82 comprises an engagement member 84. Such structure provides a latch member in the form of the second tongue portion 80 that is connected to the connector housing 14 by a separate flex member in the form of the first tongue portion 72 that is located at a finger depression area. In this manner, extreme stress concentration is not built up at the pivot point of the locking tongue 70. Such structure also allows for satisfactory deflection of the latch member in a relatively small connector module. Further, such structure permits the desired deflection at the thumb pad provided by the first tongue portion 72 thereby creating the desired deflection of the second tongue portion 80. Molding of the housing 14 is easier due to the structured features of the tongue 70.

The connector housing 12 and its lug 40 are slidably engagable with the connector housing 14 and engagement member 84, in the directions 86 and 86', of a connector module longitudinal axis 88 to fully engage the lug and the engagement member in an engaged mode, and disengage the lug and the engagement member in a disengaged mode, respectively, as described herein. When the housings 12 and 14 are in the engaged mode, the axis 88 will be coincident with axes 20 and 50.

Figure 4:
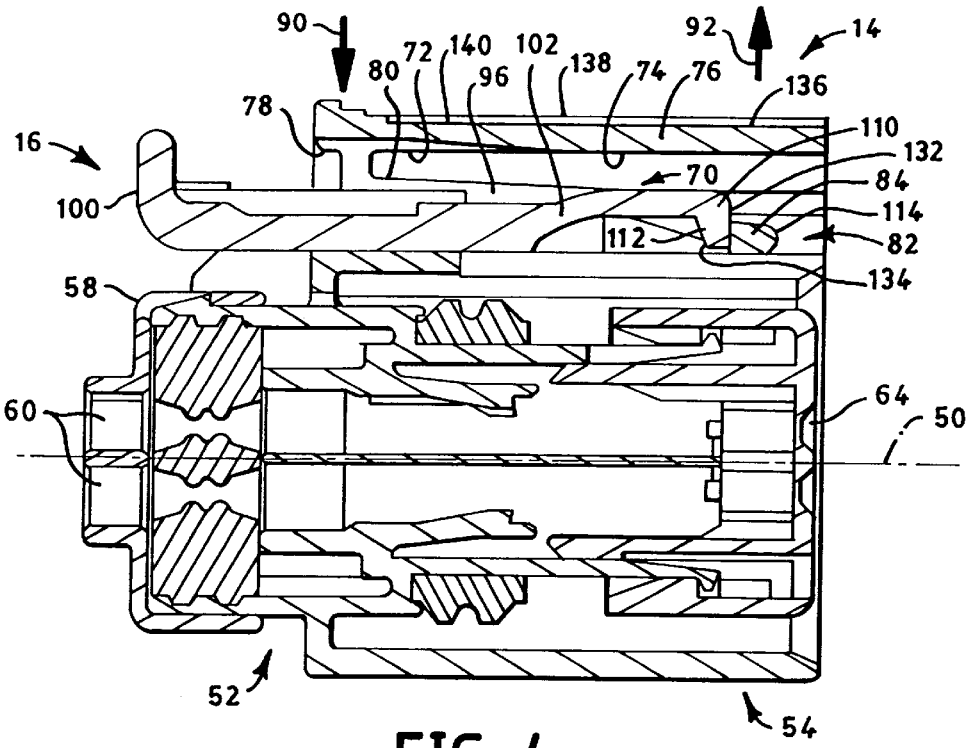
FIG. 4 is a cross-sectional view of the connector housing 14 of FIG. 1 illustrating the positive assurance member of one embodiment of the present invention in a pre-locked mode.
Figure 5:
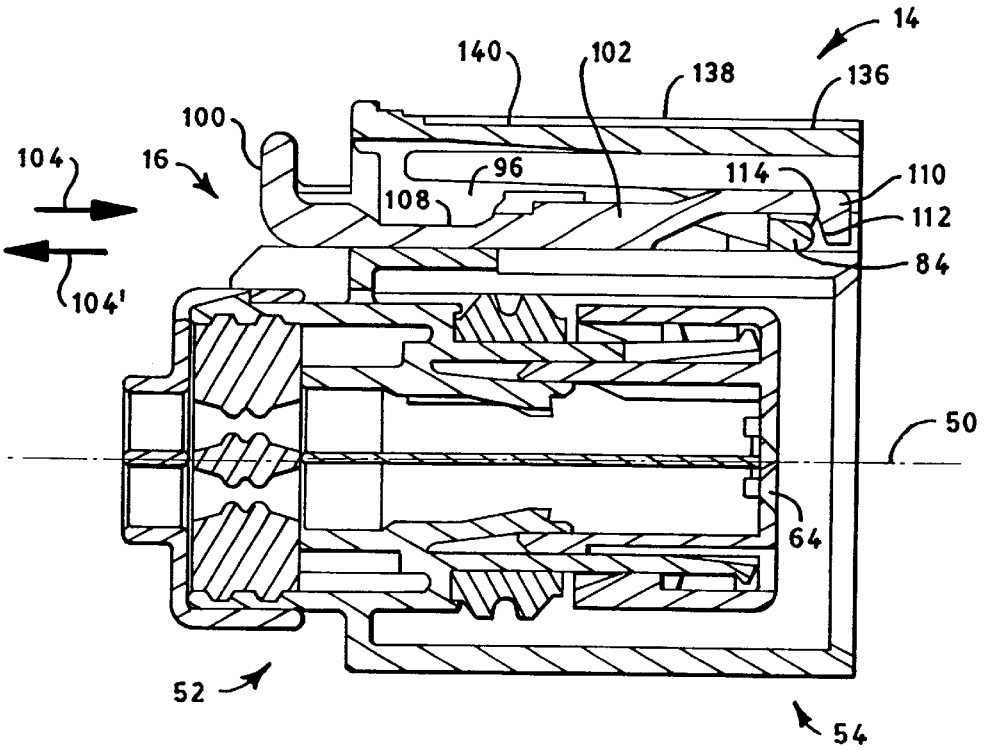
FIG. 5 is a cross-sectional view similar to FIG. 4 but illustrating the positive assurance member in a locked mode without the connector housing 12 attached to the connector housing 14.

With reference to FIG. 4, the resilient locking tongue 70 is structured and arranged such that depression of the first tongue portion 72 in the direction 90 towards axis 50 will urge the engagement member 84 in the direction 92 away from the axis 50. When the housings 12 and 14 are attached to each other, such depression permits detachment thereof in the disengaged mode as described herein.

The positive assurance member 16 is movably attached to the connector housing 14. The positive assurance member 16 is structured and arranged such that in the engaged mode, movement of the positive assurance member towards end portion 54 serves to position the positive assurance member in a locking mode wherein the positive assurance member will sufficiently resist movement of (a) the first tongue portion 72 in direction 90 towards axis 88 and (b) the engagement member 84 in direction 92 away from axis 88, to lock engagement of the lug 40 and engagement member 84 in the engaged mode; that is, to prevent disengagement of the lug and the engagement member. To this end, the positive assurance member of the present invention may comprise at least one first abutment member and at least one second abutment member. The first and second abutment members may be structured and arranged such that when in the locking mode, (a) at least one first abutment member surface is positioned relative to the locking tongue 70 to resist movement of the tongue portion 72 towards the axis 88, and (b) at least one second abutment member surface is positioned relative to the locking tongue to resist movement of the engagement member 84 away from axis 88. For example, in the embodiment illustrated in FIGS. 1, 4 and 5, the second tongue portion 80 of locking tongue 70 comprises a first leg 94 and a second leg 96 each of that extends in the direction 48 of axis 50 from the free end 78 to the engagement member 84. The legs 94 and 96 are spaced from each other to provide an opening 98 therebetween. The positive assurance member 16 comprises a base 100 and a first abutment member in the form of a resilient first arm 102 extending from the base in the direction 48 of axis 50 into the opening 98. The first arm 102 is structured and arranged such that in the engaged mode, movement of the positive assurance member 16 in a locking direction 104 relative to axis 88 serves to position a surface of the first arm adjacent the engagement member 84 so as to sufficiently resist movement of the engagement member in direction 92 and out of engagement with the lug 40 as described in more detail hereinafter.

In the embodiment illustrated in FIGS. 1 and 5–7, the positive assurance member 16 comprises two second abutment members in the form of a first region 106 and a second region 108. Only region 108 is visible in FIG. 5. The first and second regions 106, 108 are structured and arranged such that in the engaged mode, movement of the positive assurance member 16 in the direction 104 serves to position the regions 106 and 108 relative to the first and second legs 94, 96 of the locking tongue 70 so as to sufficiently resist movement of the first tongue portion 72 in direction 90 thereby further resisting the urging of the engagement member 84 in direction 92.

If desired, the positive assurance member of the present invention may be structured and arranged such that in the locking mode a first distal end surface of the first abutment member engages a first surface of the engagement member so as to prevent unlocking of the positive assurance member. For example, in the embodiment illustrated in FIG. 5, the first arm 102 comprises a hook-like distal end segment 110 that comprises a first distal end surface 112. The resilient first arm 102 is structured and arranged such that in the locking mode the surface 112 engages a surface 114 of the engagement member 84 so as to prevent movement of the positive assurance member in the direction 104' thereby preventing unlocking of the engaged lug 40 and engagement member 84.

If desired, the positive assurance member of the present invention may comprise at least one detent, and the second connector housing may comprise at least one detent abutment member, the detent being structured and arranged to engage the detent abutment member to attach the positive assurance member to the second connector housing in a pre-locked mode. For example, in the embodiment illustrated in FIGS. 6 to 8, the positive assurance member 16 comprises a resilient second arm 116 and an opposite resilient third arm 118 extending from the base 100 in the direction 48 of axis 50. Arms 116 and 118 provide resistance and rigidity useful in a relatively small connector module. The arms 116 and 118 are spaced from each other to provide an opening 120 therebetween. The first arm 102 extends into opening 120 between the second arm 116 and third arm 118. With reference to FIG. 8, the arm 116 comprises a detent 122 and the arm 118 comprises a detent 124. The second connector housing 14 comprises a first detent abutment member 126 and an opposite second detent abutment member 128 extending from respective walls 68 and 130 of cavity 56. The detents 122 and 124 are structured and arranged to engage the detent abutment members 126 and 128, respectively, to attach the positive assurance member 16 to the housing 14 in the pre-locking mode. Such arrangement prevents movement of the positive assurance member in directions 104 and 104'.

If desired, the first abutment member of the positive assurance member may comprise a second distal end surface that engages a second surface of the engagement member in the pre-locking mode. In such embodiment, such second distal end surface and second surface of the engagement member, and the detents and the detent abutment members, may be structured and arranged to resist movement of the positive assurance member in the directions 104 and 104' except in the engaged mode. For example, in the embodiment illustrated in FIG. 4, the distal end segment 110 may comprise a second distal end surface 132 that is opposite the first distal end surface 112. The resilient first arm 102 is structured and arranged such that in the pre-locked mode, the surface 132 engages a surface 134 of the engagement member 84. Surface 134 is opposite surface 114. In this embodiment, surface 132 is structured and arranged relative to the surface 134, and the detent 122 and 124 are structured and arranged relative to respective detent abutment members 126 and 128, to provide resistance to movement of the positive assurance member 16 in the directions 104 and 104' except when the housings 12 and 14 are being sidably engaged as described hereinafter.

The embodiment illustrated in the drawings may be fabricated from LCP by molding. Heretofore, filling of the mold to form an LCP connector housing 14 created a weak weld line that tended to cause the connector housing to split in the direction 48 of axis 50 along the wall portion 136 and the wall portion 138 that extends therefrom and forms the first tongue portion 72. To overcome this problem, the housing 14 may be molded from LCP in such a manner that the wall portions 136 and 138 comprise a rib 140 that extends from end portion 54 towards end portion 52 in the direction 48 of axis 50. Rib 140 eliminates the tendency for the housing 14 to split at the surface portions 136 and 138 and also provides reinforcement at the first tongue portion 72 that is flexed during use of the connector module.

Figure 6:
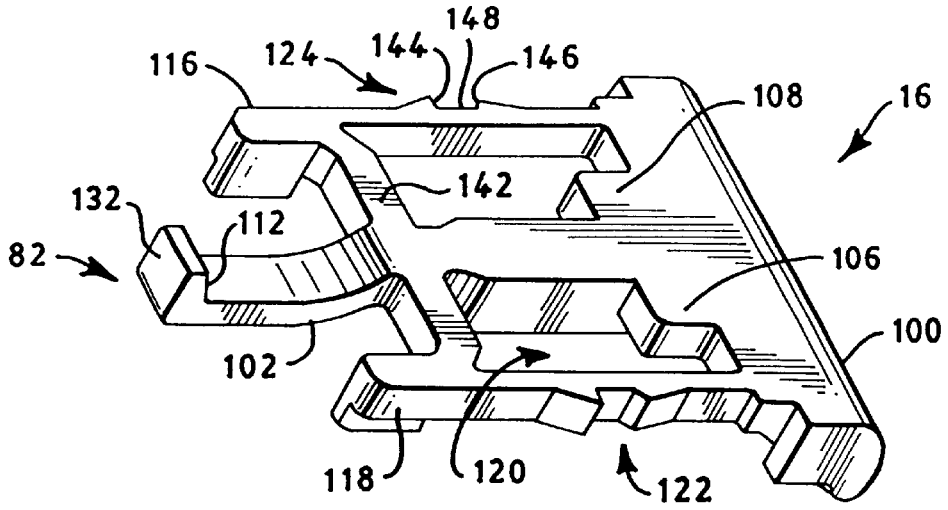
FIG. 6 is a bottom perspective view of the positive assurance member of FIG. 1.
Figure 7:
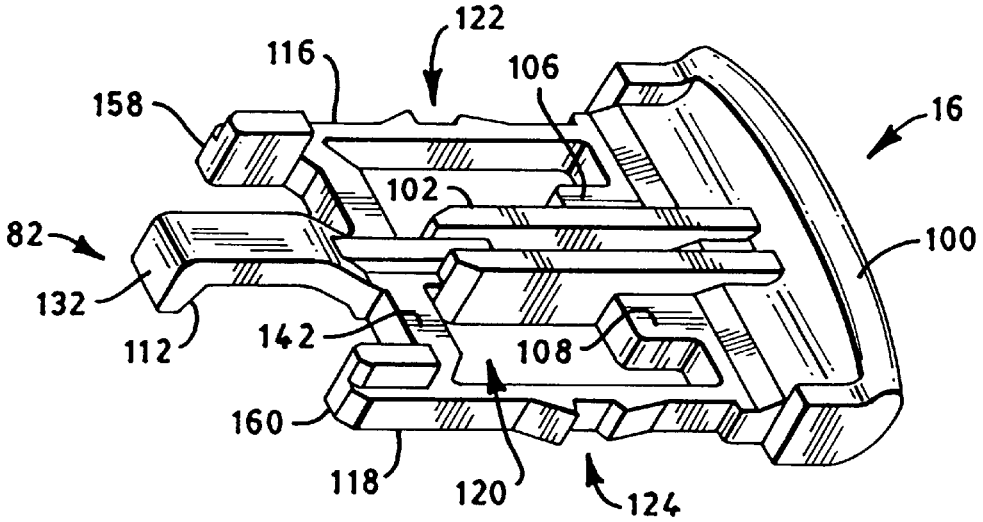
FIG. 7 is a top perspective view of the positive assurance member illustrated in FIG. 6.
Figure 8:
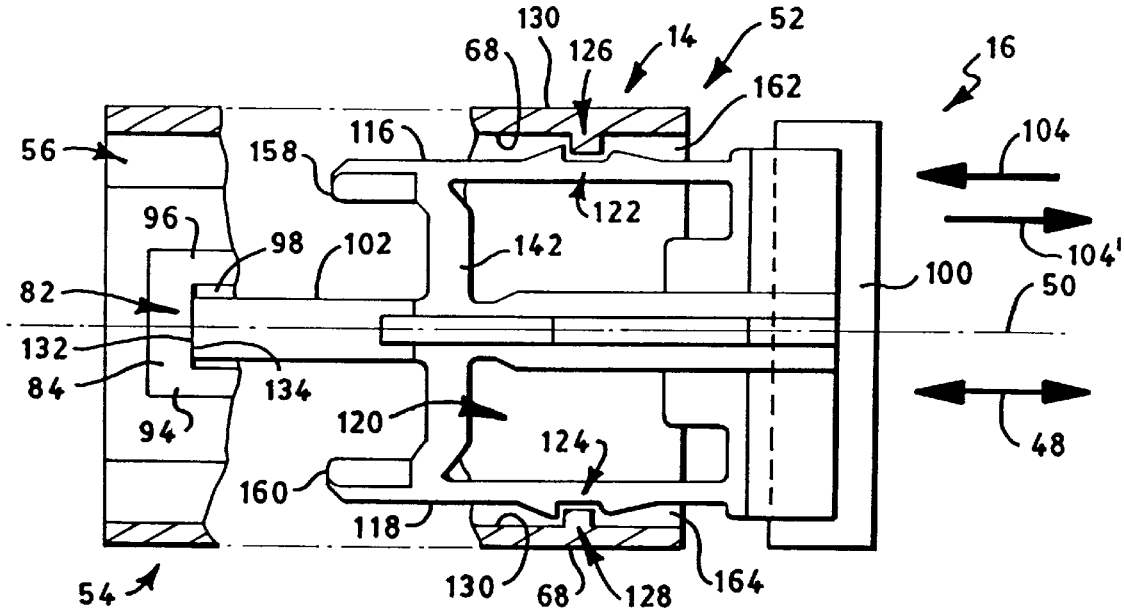
FIG. 8 is a plan view of the positive assurance member of FIG. 7 illustrated within the connector housing 14 of FIG. 1 in a pre-locked mode.

In the embodiment illustrated in FIGS. 6 to 8, the positive assurance member 16 comprises a bridging member 142 that extends between the first arm 102 and the second arm 116, and the first arm 102 and the third arm 118.

Figure 9:
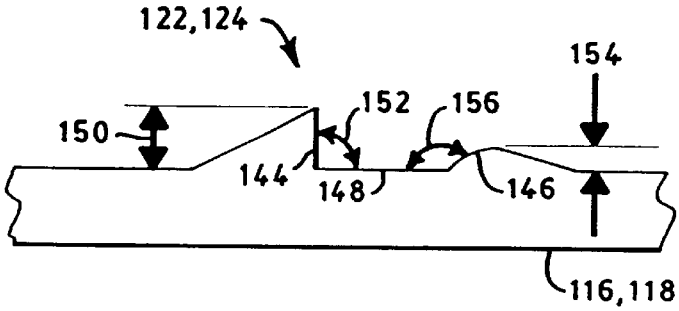
FIG. 9 is an enlarged view of the detents of the positive assurance member of FIG. 8.

The positive assurance member of the present invention may be structured and arranged to assure that in the pre-locked mode the positive assurance member remains in a fixed position relative to the second connector housing, and in the engaged mode the positive assurance member is moveable to a locked mode. For example, with reference to FIGS. 6 to 9, the detents 122 and 124 may each comprise a first detent surface 144, and an opposite second detent surface 146, extending from a detent base 148. In such embodiment, the first and second detent abutment members 126 and 128 extend between respective detent surfaces 144 and 146 in the pre-locked mode. With reference to FIG. 9, each first detent surface 144 extends from the detent base 148 a first length 150 and at a first angle 152 that are sufficient to substantially permanently attach the positive assurance member to the connector housing 14 in the pre-locked mode. Each second detent surface 146 extends from the detent base 148 a second length 154 and at a second angle 156 that are sufficient to permit movement of the positive assurance member 16 in the direction 104 relative to the longitudinal axis 88 when the connector module is in the engaged mode, as described hereinafter. In the embodiment illustrated in FIGS. 6 to 9, angle 152 is 90° and the length 150 is such that in combination with the 90° orientation of the detent surface 144, once in the pre-locked position illustrated in FIG. 8, movement of the positive assurance member 16 in direction 104' is not possible. The angle 156 is an acute angle and the length 154 is such that in combination with the acute angular orientation of the detent surface 146, movement of the positive assurance member 16 in direction 104 is possible when the housings 12 and 14 are in the engaged mode.

The use of the connector module illustrated in the drawings is described hereinafter. The connector housing 14 and positive assurance member 16 are first assembled in a pre-locked mode. To this end, the positive assurance member 16 is inserted into opening 56 of housing 14 from end portion 52 in direction 104 as best illustrated in FIGS. 3 and 8. In particular, the ends 82, 158 and 160 of arms 102, 116 and 118, respectively, are inserted into the opening 56 such that legs 116 and 118 slide along channel surfaces 162 and 164 of housing 14, and leg 102 slides within opening 98 between legs 94 and 96 of the locking tongue 70. Sliding continues until the surface 132 of the end 82 of the arm 102 is adjacent the surface 134 of the engagement member 84, and the detent abutment members 126 and 128 engage respective detents 122 and 124, in the pre-locked mode illustrated in FIG. 8. In such position, the positive assurance member 16 is locked to the connector housing 14. In particular, movement of the positive assurance member 16 in direction 104 will be prevented by engagement of surfaces 132 and 134, and movement in the direction 104' will be prevented by engagement of the detent abutment members 126 and 128 with respective detent surfaces 144 of respective detents 122 and 124.

Figure 10A:
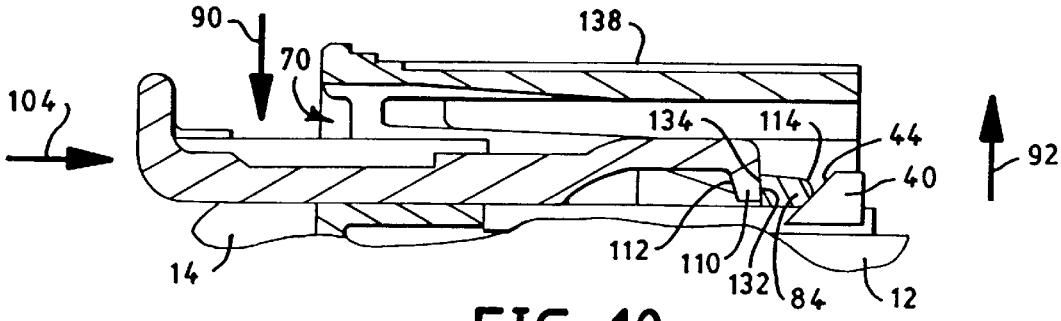
FIGS. 10*a* to 10*d* illustrate the operation of the connector module of FIG. 1.
Figure 10B:
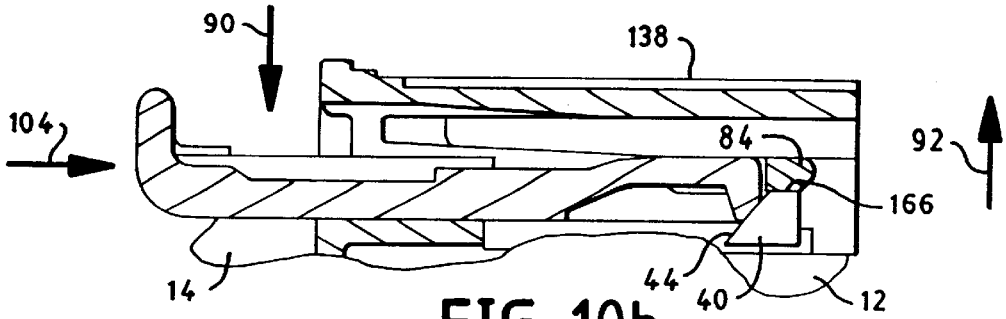
Figure 10C:
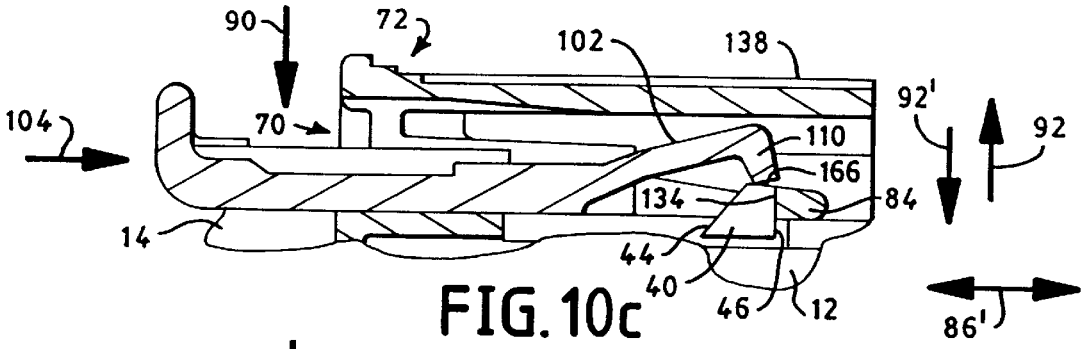

With reference to FIGS. 1 and 10*a* to 10*c*, when it is desired to connect together the connector housings 12 and 14, the key 36 is mated with the keyway 66, and the end portion 26 of housing 12 is then inserted into opening 56 of housing 14 at end portion 54. As the housing 12 is inserted into opening 56, the surface 44 of lug 40 engages the surface 114 of the engagement member 84 of the locking tongue 70 as illustrated in FIG. 10*a*. Continued movement of the housing 12 into the opening 56 causes the surface 44 to cam the engagement member 84 in direction 92 until the engagement member rests upon the upper surface 166 of the lug 40 as illustrated in FIG. 10*b*. Continued movement of the housing 12 into the opening 56 causes (a) the engagement member 84 to resile in direction 92' such that surface 134 of the engagement member 84 is adjacent surface 46 of the lug, and (b) the surface 44 to cam the distal end segment 110 of the arm 102 in direction 92 until the segment 110 rests upon the upper surface 166 of the lug 40 as illustrated in FIG. 10*c*. When in the position illustrated in FIG. 10*c*, the connector housings 12 and 14 are fully attached to one another in the engaged mode.

When in the position illustrated in FIG. 10*c*, the housings 12 and 14 may be disengaged from each other by placing the locking tongue 70 in a disengaged mode by depressing the first tongue portion 72 of the locking tongue 70 in direction 90 sufficiently to cause the engagement member 84 to move in direction 92 to thereby move surface 134 out of the path of the surface 46 of the lug 40. In such position, the lug 40 will no longer engage the engagement member 84 when the housings are moved in direction 86' and therefore will no longer prevent disengagement of the housings 12 and 14.

Figure 10D:
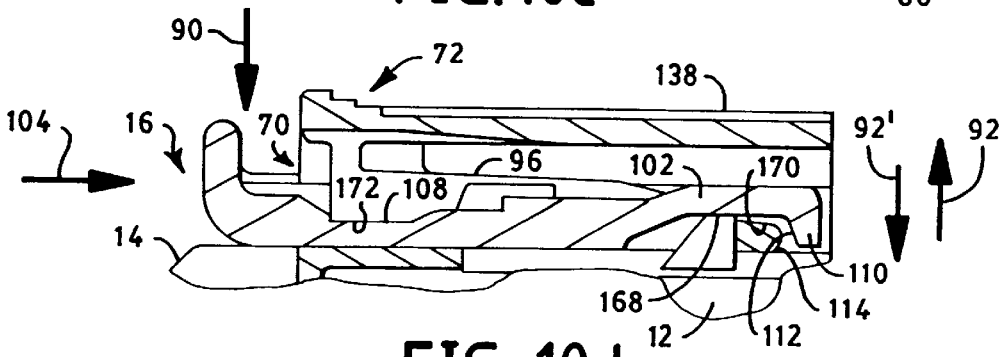

With reference to FIGS. 8, 9 and 10*d*, when it is desired to lock the connector housings 12 and 14 together after they are in the engaged mode, the positive assurance member 16 is urged in direction 104 with sufficient force that the resilient legs 116 and 118 flex sufficiently to overcome the resistance to movement in direction 104 provided by the engagement of the detent surfaces 146 with respective detent abutment members 126 and 128. Continued movement of the positive assurance member 16 is direction 104 causes the distal end segment 110 of the arm 102 to resile in direction 92' such that lug 40 enters opening 98 between legs 94 and 96, and surface 112 is adjacent surface 114 as illustrated in FIG. 10*d*. When in this position the surface 168 of the arm 102 is adjacent a surface 170 of the engagement member 84 of the locking tongue 70, and the regions 106 and 108 of the positive assurance member 16 are adjacent surfaces 172 of respective legs 94 and 96 of the locking tongue. In this locked mode illustrated in FIG. 10*d*, the connector housings 12 and 14 can not be disconnected because the surface 134 of the engagement member of the locking tongue 70 of housing 14 can not be removed from engagement with the surface 46 of the lug 40 of housing 12. Such removal is prevented because the engagement of the regions 106 and 108 with the surfaces 172 prevents depression of the first tongue portion 72 in direction 90, and engagement of the surface 168 with the surface 170 will prevent movement of the engagement member 84 in the direction 92.

The embodiments that have been described herein are but some of several that utilize this invention and are set forth here by way of illustration but not of limitation. It is apparent that many other embodiments that will be readily apparent to those skilled in the art may be made without departing materially from the spirit and scope of this invention.

What is claimed is:

1. A connector module, comprising:

a first connector housing extending from a first end portion to an opposite second end portion and comprising a lug extending from a first connector housing wall;

a second connector housing extending from one end portion to an opposite end portion and comprising a resilient locking tongue, said locking tongue comprising a first tongue portion extending from a fixed attached to a second connector housing wall to a first free end and a second tongue portion extending from said first free end to an opposite second free end, said second free end comprising an engagement member, said second connector housing being slidably engagable with said first connector housing in the direction of a longitudinal axis, to fully engage and disengage said lug and said engagement member in an engaged and disengaged mode, respectively, said resilient locking tongue being structured and arranged such that movement of said first tongue portion towards said longitudinal axis causes movement of said engagement member away from said longitudinal axis in a disengaged mode, and release of said first tongue portion permits said engagement member to resile towards said longitudinal axis, in an engaged mode;

said second connector housing wall comprising an outer surface with a rib which extends from one end portion toward said another end portion, said rib extending alone an outer surface of said first tongue portion; and a positive assurance member movably attached to said second connector housing and structured and arranged such that in said engaged mode, movement of said positive assurance member in a locking direction positions said positive assurance member in relation to said locking tongue to sufficiently resist said movement of said first tongue portion towards, and said engagement member away from, said longitudinal axis to lock engagement of said lug and said engagement member in a locked mode.

2. The connector module of claim 1 wherein said positive assurance member comprises at least one first abutment member and at least one second abutment member, said first and second abutment members being structured and arranged such that (a) at least one first abutment member surface is positioned relative to said locking tongue to resist said movement of said engagement member away from said longitudinal axis in said locked mode, and (b) at least one second abutment member surface is positioned relative to said locking tongue to resist said movement of said first tongue portion towards said longitudinal axis in said locked mode.

3. The connector module of claim 2 wherein said at least one first abutment member comprises a first distal end surface engagable with a first surface of said engagement member in said locked mode so as to prevent movement of said positive assurance member in a direction opposite to said locking direction.

4. The connector module of claim 3 wherein said positive assurance member comprises at least one detent, and said second connector housing comprises at least one detent abutment member, said detent being structured and arranged to engage said detent abutment member to attach said positive assurance member to said second connector housing in a pre-locked mode.

5. The connector module of claim 4 wherein said at least one first abutment member comprises a second distal end surface engagable with a second surface of said engagement member in said pre-locked mode, said second distal end surface and said second surface of said engagement member, and said detent and said detent abutment member, being structured and arranged to resist movement of said positive assurance member in the direction of said longitudinal axis except in said engaged mode.

6. The connector module of claim 5 wherein said lug and said first abutment member are structured and arranged such that said lug is engagable with said first abutment member to displace said first abutment member away from said longitudinal axis to permit movement of said positive assurance member in said locking direction.

7. The connector module of claim 1 wherein said second connector housing wall comprises an outer surface comprising a rib that extends from said one end portion towards said another end portion, said rib extending along an outer surface of said first tongue portion.

8. The connector module of claim 1 wherein said second tongue portion comprises a first leg and a second leg each extending from said first free end to said engagement member, said first and second legs being spaced from each other to provide an opening therebetween, and further wherein said positive assurance member comprises a base and a resilient first arm extending from said base into said opening, said first arm structured and arranged such that in said engaged mode, movement of said positive assurance member in said locking direction serves to position said first arm adjacent said engagement member so that said first arm resists said movement of said engagement member in said locked mode.

9. The connector module of claim 8 wherein said positive assurance member comprises a first region aligned with said first leg and a second region aligned with said second leg, said first and second regions being structured and arranged such that in said engaged mode, movement of said positive assurance member in said locking direction serves to position said first and second regions adjacent said first and second legs, respectively, so that said first and second regions resist said movement of said first tongue portion, in said locked mode.

10. The connector module of claim 9 wherein said positive assurance member further comprises a resilient second arm and an opposite resilient third arm spaced from said second arm, said second and third arms extending from said base, said first arm extending between said second and third arms, said second arm comprising a first detent and said third arm comprising an opposite second detente and further wherein said second connector housing comprises a first detent abutment member and an opposite second detent abutment member, said first and second detents being structured and arranged to engage said first and second detent abutment members, respectively, to attach said positive assurance member to said second connector housing in a pre-locked mode.

11. The connector module of claim 10 wherein said first arm comprises a first distal end surface and an opposite second distal end surface, said first distal end surface being engagable with a first surface of said engagement member in said locked mode so as to prevent movement of said positive assurance member in a direction opposite to said locking direction, and said second distal end surface being engagable with an opposite second surface of said engagement member in a pre-locked mode, said second distal end surface and said second surface of said engagement member, and said first and second detents and respective first and second detent abutment members, being structured an arranged to resist movement of said positive assurance member in the direction of said longitudinal axis except in said engaged mode.

12. The connector module of claim 11 wherein said lug and said first abutment member are structured and arranged such that said lug is engagable with said first abutment member to displace said first abutment member away from said longitudinal axis to permit movement of said positive assurance member in said locking direction.

13. The connector module of claim 12 wherein said second connector housing wall comprises an outer surface comprising a rib that extends from said one end portion towards said another end portion, said rib extending along an outer surface of said first tongue portion.

14. The connector module of claim 12 wherein said first connector housing comprises a first key member and said second connector housing comprising a second key member matable with said first key member to facilitate slidable engagement of said first connector housing with said second connector housing.

15. The connector module of claim 10 wherein said positive assurance member comprises a bridging member extending between said first arm and said second arm, and said first arm and said third arm.

16. The connector module of claim 12 wherein said first detent and said second detent each comprise a first detent surface and an opposite second detent surface extending from a detent base, said first and second detent abutment members extending between respective first and second detent surfaces in said pre-locked mode, said first detent surface extending from said detent base a first distance and at a first angle that are sufficient to substantially permanently attach said positive assurance member to said second connector housing in said pre-locked mode, and said second detent surface extending from said detent base a second distance and at a second angle that are sufficient to permit movement of said positive assurance member in said locking direction in said engaged mode.

17. A connector module, comprising:

a first connector housing extending from a first end portion to an opposite second end portion and comprising a lug extending from a first connector housing wall;

a second connector housing extending from one end portion to an opposite end portion and comprising a resilient locking tongue, said locking tongue comprising a first tongue portion extending from a fixed attached to a second connector housing wall to a first free end and a second tongue portion extending from said first free end to an opposite second free end, said second free end comprising an engagement member, said second connector housing being slidably engagable with said first connector housing in the direction of a longitudinal axis, to fully engage and disengage said lug and said engagement member in an engaged and disengaged mode, respectively, said resilient locking tongue being structured and arranged such that movement of said first tongue portion towards said longitudinal axis causes movement of said engagement member away from said longitudinal axis in a disengaged mode, and release of said first tongue portion permits said engagement member to resile towards said longitudinal axis, in an engaged mode; and a positive assurance member movably attached to said second connector housing having a first detent and a second detent, each detent comprise a first detent surface and an opposite second detent surface extending from a detent base, first and second detent abutment members provided on the second connector housing extending between respective first and second detent surfaces in a pre-locked mode, said first detent surface extending from a detent base a first distance and at a first angle that are sufficient to substantially permanently attach said positive assurance member to said second connector housing in said pre-locked mode, and structured and arranged such that in said engaged mode, movement of said positive assurance member in a locking direction positions said positive assurance member in relation to said locking tongue to sufficiently resist said movement of said first tongue portion towards, and said engagement member away from, said longitudinal axis to lock engagement of said lug and said engagement member in a locked mode, and said second detent surface extending from said detent base a second distance and at a second angle that are sufficient to permit movement of said positive assurance member in said locking direction in said engaged mode.

18. The connector module of claim 17 wherein said second tongue portion comprises a first leg and a second leg each extending from said first free end to said engagement member, said first and second legs being spaced from each other to provide an opening therebetween, and further wherein said positive assurance member comprises a base and a resilient first arm extending from said base into said opening, said first arm structured and arranged such that in said engaged mode, movement of said positive assurance member in said locking direction serves to position said first arm adjacent said engagement member so that said first arm resists said movement of said engagement member in said locked mode.

19. The connector module of claim 18 wherein said positive resistance member comprises a first region aligned with said first leg and a second region aligned with said second leg, said first and second regions being structured and arranged such that in said engaged mode, movement of said positive assurance member in said locking direction serves to position said first and second regions adjacent said first and second legs, respectively, so that said first and second regions resist said movement of said first tongue portion, in said locked mode.

20. The connector module of claim 19 wherein said positive assurance member further comprises a resilient second arm and an opposite resilient third arm spaced from said second arm, said second and third arms extending from said base, said first arm extending between said second and third arms, said second arm comprising said first detent and said third arm comprising said opposite second detent, and further wherein said second connector housing comprises said first detent abutment member and said opposite second detent abutment member, said first and second detents being structured and arranged to engage said first and second detent abutment members, respectively, to attach said positive assurance member to said second connector housing in a pre-locked mode.

21. The connector module of claim 20 wherein said first arm comprises a first distal end surface and an opposite second distal end surface, said first distal end surface being engagable with a first surface of said engagement member in said locked mode so as to prevent movement of said positive assurance member in a direction opposite to said locking direction, and said second distal end surface being engagable with an opposite second surface of said engagement member in a pre-locked mode, said second distal end surface and said second surface of said engagement member, and said first and second detents and respective first and second detent abutment members, being structured an arranged to resist movement of said positive assurance member in the direction of said longitudinal axis except in said engaged mode.

* * * * *